US005096059A

United States Patent [19]

Henderson

[11] Patent Number: 5,096,059

[45] Date of Patent: Mar. 17, 1992

[54] ACCESSORY SADDLE MEMBER FOR A GOLF BAG

[76] Inventor: Dennis W. Henderson, 6 Warner St., Warners Bay 2282, Newcastle, N.S.W., Australia

[21] Appl. No.: 670,725

[22] Filed: Mar. 18, 1991

[51] Int. Cl.[5] ..... A63B 55/02

[52] U.S. Cl. ..... 206/315.5; 206/315.3; 224/918; 224/919

[58] Field of Search ..... 206/315.3, 315.5; 224/255, 274, 915, 918, 919

[56] References Cited

U.S. PATENT DOCUMENTS

| | | | |
|---|---|---|---|
| 1,973,819 | 9/1934 | Link | 224/918 |
| 3,010,628 | 11/1961 | Kowalczyk | 224/274 |
| 4,032,054 | 6/1977 | Duncan | 224/274 |
| 4,350,194 | 9/1982 | Brown | 206/315.5 |
| 4,459,827 | 7/1984 | Rhodes | 224/274 |
| 4,625,862 | 12/1986 | Clayton | 206/315.3 |
| 4,850,483 | 7/1989 | Stack | 224/919 |
| 4,869,365 | 9/1989 | Perdue et al. | 206/315.5 |
| 4,924,682 | 5/1990 | Penner | 206/315.3 |

FOREIGN PATENT DOCUMENTS

| | | | |
|---|---|---|---|
| 613456 | 1/1961 | Canada | 224/915 |

*Primary Examiner*—Stephen P. Garbe
*Assistant Examiner*—Christopher McDonald
*Attorney, Agent, or Firm*—Goodman & Teitelbaum

[57] ABSTRACT

An accessory saddle member for attachment to an existing golf bag by saddling a back portion of the golf bag and lapping opposing sides of the golf bag, the accessory saddle member being fabricated from a pliable waterproof or water-resistant material, and including pockets thereon for carrying golf related and personal items, where the pockets are closeable. An aperture is provided in the body of the accessory saddle member for receiving a handle of the golf bag to position the body on the golf bag. The body is provided with upper and lower straps on one side thereof so that the straps can be positioned around the golf bag and the ends of the straps can be secured by releasable fasteners to the opposite side of the body to securely hold the body on the golf bag.

15 Claims, 1 Drawing Sheet

ACCESSORY SADDLE MEMBER FOR A GOLF BAG

BACKGROUND OF THE INVENTION

The invention relates to a golf bag accessory and, more particularly, to an accessory saddle member having pockets thereon for carrying golf related and personal items which can be attached to any existing golf bag.

For many golfers, the need to constantly bend down for golf related and personal items, and the inability to conveniently transport drinks, wet weather clothing, golf shoes and the like causes discomfort and inconvenience to the golfer.

There has been previous proposals for changing the position of the accessory pockets and the like of a golf bag to overcome the shortcomings of the conventional golf bag. However, such accessory pockets continue to be positioned at the base of the conventional golf bag and therefore do not offer the user of the golf bag easy access to the golf balls, tees, markers and like golf related items, nor have these auxiliary pockets been utilized as fully as they could be to maximize the convenience of the golfer. Additionally, previous accessory pockets have usually been made a component part of the conventional golf bag, and therefore lack the ability to transfer these accessory pockets and their contents to another golf bag if required.

SUMMARY OF THE INVENTION

It is an object of this invention to overcome the above-mentioned deficits.

Another object of the present invention is to provide an accessory saddle member which can be easily attached to a golf bag, having pockets thereon for carrying golf related and personal items.

A further object of the present invention is to provide an auxiliary saddle member for a golf bag which is fabricated from a pliable waterproof or water-resistant material for protection thereof from adverse weather conditions.

Still another object of the present invention is to provide an accessory saddle member for a golf bag that is inexpensive to manufacture and can easily be positioned on and removed from the golf bag.

Briefly, in accordance with the present invention, an accessory saddle member is provided which can be attached to any existing golf bag by saddling a back portion of the golf bag and lapping opposing sides of the golf bag. The accessory saddle member is fabricated from a pliable waterproof or water-resistant material and includes pockets thereon for carrying golf related and personal items, where the pockets are closeable. An aperture is provided in the body of the accessory saddle member for receiving a handle of the golf bag to position the body on the golf bag. The body is provided with upper and lower straps on one side thereof so that the straps can be positioned around the golf bag and the ends of the straps can be secured by releasable fasteners to the opposite side of the body to securely hold the body on the golf bag.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawings, like reference characters designate like parts.

DESCRIPTION OF THE PREFERRED EMBODIMENTS

Figure 1:
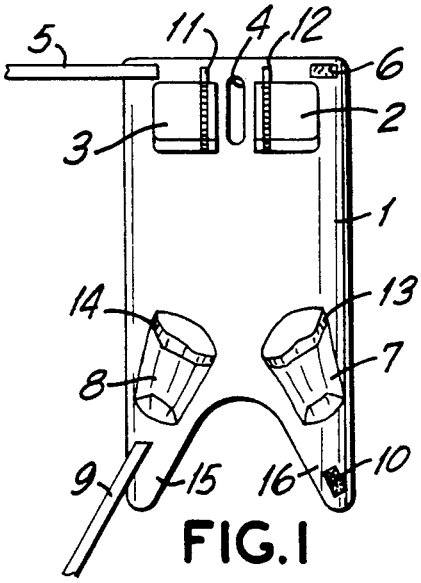
FIG. 1 is a front view of an accessory saddle member for a golf bag according to the present invention.
Figure 4:
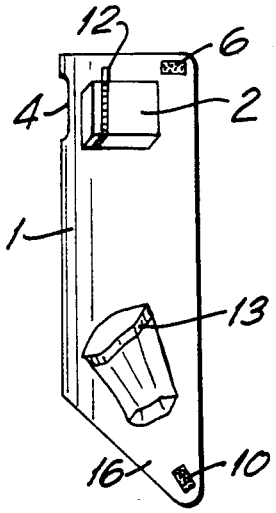
FIG. 4 is a side view of the accessory saddle member showing the right side thereof in the saddle position when mounted on the golf bag.
Figure 2:
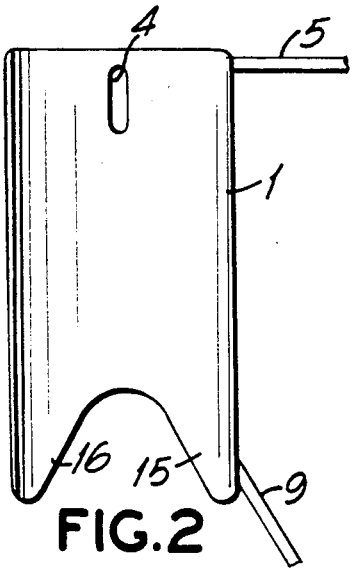
FIG. 2 is a rear view of the accessory saddle member.
Figure 3:
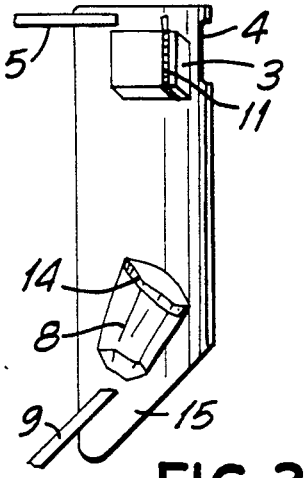
FIG. 3 is a side view of the accessory saddle member showing the left side thereof in the saddle position when mounted on the golf bag.
Figure 5:
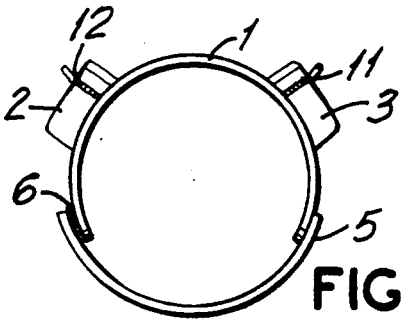
FIG. 5 is a top view of the accessory saddle member in the saddle position when mounted on the golf bag.
Figure 6:
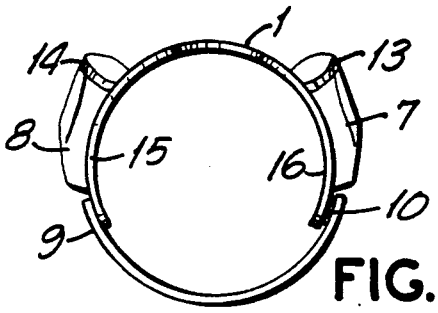
FIG. 6 is a bottom view of the accessory saddle member in the saddle position when mounted on the golf bag.

Referring to the drawings, FIGS. 1 and 2 show the front and rear of the accessory saddle member for a golf bag according to the present invention, which includes a body 1 having a substantially thin thickness, as indicated in FIGS. 5 and 6 so that the body 1 is pliable. The body 1 is fabricated from waterproof or water-resistant material, such as plastic, leather, vinyl, nylon, sail cloth and the like, to protect the contents thereof from adverse weather conditions, and also to protection portions of the golf bag itself.

An aperture 4, preferably a centrally located rectangular vertical slot adjacent the top edge of the body 1, is provided in the body 1 for receiving a handle of the golf bag to position the body 1 on the golf bag without interfering with the normal use of the handle. The bottom half of the body 1 is shaped to have two opposing spaced apart lower leg portions 15,16.

A bottom strap 9 is secured to the lower leg portion 15 of the body 1, and a second upper strap 5 is secured to an upper portion of the body 1 disposed vertically above the bottom strap 9. Lower releasable fastener means are connected to an end of the bottom strap 9 and also to the lower leg portion 16 in the form of a tab 10. Additionally, upper releasable fastener means are connected to the end of the upper strap 5 and to an opposing upper portion of the body 1 in the form of a tab 6 which is disposed vertically above the tab 10. The releasable fastener means will be described in more detail below.

The upper half of the body 1 has two pockets 2,3 thereon, preferably on opposite sides of the aperture 4 so that the openings of the pockets 2,3 face each other. Zippers 11 and 12 are used to open and close the pockets 3 and 2 respectively for easy access to the pockets so that the golfer does not have to bend down when reaching for the items contained within the pockets. Additionally, two multi-purpose larger pockets 7 and 8 are disposed on the lower half of the body 1, extending upwardly at an inwardly directed angle from the lower leg portions 16 and 15, respectively, with the openings of the pockets 7 and 8 being provided at the top portions thereof. The larger pockets 7 and 8 have elastic material 13 and 14 around the openings thereof for closing the pockets 7 and 8 while still allowing the openings of the pockets 7 and 8 to expand and provide storage in addition to a firm positioning for drinks and clothing during golf play, and for holding golf shoes when not in play. Obviously, in place of the above-mentioned zippers 11,12 and elastic material 13,14, the pockets can be closed or opened by VELCRO fasteners, snap fasteners, hook and eye fasteners, buttons and eyelets fasteners and the like. The term VELCRO is a registered trademark of American Velcro, Inc., and is well known in the fastener art to consist of a first portion containing loops and an associated second portion containing hooks so that the portions can be releasably secured together.

In mounting the body 1 on the golf bag, the handle of the golf bag is first inserted through the aperture 4, as mentioned above, to position the body 1 on a back portion of the golf bag in a saddle position lapping opposing sides of the golf bag, as indicated in FIGS. 3, 4, 5 and 6. The upper and lower straps 5,9 are wrapped around the front portion of the golf bag and the ends thereof are secured to the tabs 6, 10 by the releasable fastener means as shown in FIGS. 5 and 6. In this case, the pair of straps 5 and 9 are fabricated from VELCRO as are the pair of tabs 6 and 10, where as would be obvious to one skilled in the fastener art, one pair contains the loops and the other associated pair contains the hooks, so that the body 1 is securely held on the golf bag when the VELCRO fasteners are secured together.

It is understood, that the straps 5 and 9 can be fabricated from other types of material, such as leather, string, rope, elastic, plastic, metal and like materials, where a VELCRO fastener, either the loops or the hooks, would be connected to the ends of the straps 5 and 9 for attachment to the VELCRO fasteners, either the hooks if the straps 5 and 9 contain the loops, or the loops if the straps 5 and 9 contain the hooks, on the tabs 6 and 10 in the same manner as mentioned above. However, other types of releasable fastener means can be used in place of the above-mentioned VELCRO fasteners, as described below.

Figure 7:
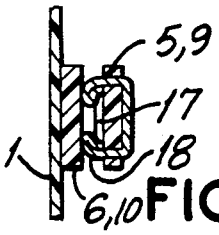
FIG. 7 is a cross-sectional view showing a modified snap type releasable fastener for the straps.
Figure 8:
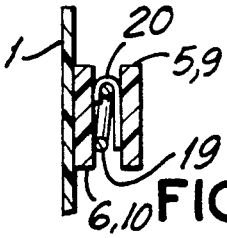
FIG. 8 is a cross-sectional view showing a further modified hook and eye type releasable fastener for the straps.
Figure 9:
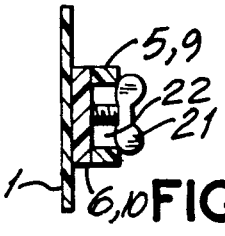
FIG. 9 is a cross-sectional view showing a still further modified button and eyelet type releasable fastener for the straps.

Referring now to FIGS. 7, 8 and 9, each shows the strap 5 or 9 connected to the tab 6 or 10 after the strap 5 or 9 has been wrapped around the front portion of the golf bag to securely hold the body 1 on the golf bag. FIG. 7 shows the male portion 17 of a snap fastener connected to the tab 6 or 10 and connectably received in a female portion 18 of the snap fastener connected to the strap 5 or 9 for securement thereof. FIG. 8 shows an eye 19 connected to the tab 6 or 10 which is engaged by a hook 20 connected to the strap 5 or 9 for securement thereof. FIG. 9 shows a button 21 connected to the tab 6 or 10 which is received through an eyelet 22 provided in the strap 5 or 9 for connection thereof.

Numerous alterations of the structures herein discussed will suggest themselves to those skilled in the art. However, it is to be understood that the present disclosure relates to preferred embodiments of the invention which are for the purpose of illustration only, and are not to be construed as a limitation of the invention.

What is claimed is:

1. An accessory saddle member for a golf bag, comprising:

a pliable body for saddling a back portion of the golf bag and lapping opposing sides of the golf bag;

aperture means provided in said body for receiving a handle of the golf bag to position said body on the golf bag;

said body having first and second opposing spaced apart lower leg portions;

a bottom strap secured to said first lower leg portion;

an upper strap secured to a first upper portion of said body disposed vertically above said bottom strap;

first releasable fastener means for securing a free end of said bottom strap to said second lower leg portion to securely hold a bottom half of said body on the golf bag;

second releasable fastener means for securing a free end of said upper strap to a second upper portion of said body to securely hold a top half of said body on the golf bag, said second upper portion being opposite said first upper portion and being disposed vertically above said second lower leg portion;

said body including at least two pockets on said top half and at least two pockets on said bottom half for carrying golf related and personal items;

closure means provided on said pockets for maintaining the items in said pockets; and said body being fabricated from a waterproof or water-resistant material.

2. An accessory saddle member according to claim 1, wherein at least one of said releasable fastener means includes a first fastener portion containing loops and an associated second fastener portion containing hooks so that said first and second fastener portions can be releasably secured together.

3. An accessory saddle member according to claim 1, wherein at least one of said releasable fastener means is a hook and eye fastener.

4. An accessory saddle member according to claim 1, wherein at least one of said releasable fastener means is a snap fastener.

5. An accessory saddle member according to claim 1, wherein at least one of said releasable fastener means is a button and eyelet fastener.

6. An accessory saddle member according to claim 1, wherein said straps are fabricated from a leather material.

7. An accessory saddle member according to claim 1, wherein said straps are fabricated from a plastic material.

8. An accessory saddle member according to claim 1, wherein said straps are fabricated from a metal material.

9. An accessory saddle member according to claim 1, wherein said straps are fabricated from an elastic material.

10. An accessory saddle member according to claim 1, wherein each of said straps is a string.

11. An accessory saddle member according to claim 1, wherein said closure means includes a zipper.

12. An accessory saddle member according to claim 1, wherein said closure means includes an elastic material.

13. An accessory saddle member according to claim 1, wherein said straps are fabricated from an elastic material, said releasable fastener means include first fastener portions containing loops and associated second fastener portions containing hooks so that said first and second fastener portions can be releasably secured together, said closure means for said two pockets on said top half are zippers, and said closure means for said two pockets on said bottom half include an elastic material.

14. An accessory saddle member according to claim 1, wherein said straps are fabricated from a material containing hooks for releasable securement to associated loops disposed on said second lower leg portion and said second upper portion of said body.

15. An accessory saddle member according to claim 1, wherein said straps are fabricated from a material containing loops for releasable securement to associated hooks disposed on said second lower leg portion and said second upper portion of said body.

* * * * *